United States Patent [19]

Jones

[11] Patent Number: 4,533,487

[45] Date of Patent: Aug. 6, 1985

[54] PROCESS FOR PRODUCING BLENDED D-LIMONENE AND USES OF THE BLENDED PRODUCT

[75] Inventor: Clarence L. Jones, Houma, La.

[73] Assignee: Pitre-Jones, Houma, La.

[21] Appl. No.: 654,902

[22] Filed: Sep. 27, 1984

Related U.S. Application Data

[63] Continuation-in-part of Ser. No. 523,049, Aug. 15, 1983, abandoned.

[51] Int. Cl.[3] ..... C11D 1/83; C11D 3/18; C11D 3/43; C11D 11/00

[52] U.S. Cl. ..... 252/170; 208/180; 252/122; 252/132; 252/153; 252/171; 252/172; 252/173; 252/541; 252/DIG. 8; 252/DIG. 14; 252/DIG. 19

[58] Field of Search ..... 252/162, 170, 171, 172, 252/173, 541, 153, DIG. 14

[56] References Cited

U.S. PATENT DOCUMENTS

| | | | |
|---|---|---|---|
| 3,933,674 | 1/1976 | Farnsworth | 252/171 |
| 4,336,151 | 6/1982 | Like | 252/106 |
| 4,414,128 | 11/1983 | Goffinet | 252/111 |

FOREIGN PATENT DOCUMENTS

| | | | |
|---|---|---|---|
| 2033421 | 5/1980 | United Kingdom | 252/170 |
| 1603047 | 11/1981 | United Kingdom | 252/162 |

*Primary Examiner*—Dennis L. Albrecht
*Attorney, Agent, or Firm*—George A. Bode

[57] ABSTRACT

A process for producing a multi-use cleansing agent basically harmless to human skin from d-Limonene, a natural citrus peel oil derivative. The d-Limonene extract, having the basic formula C10H16 is high in citric acid, carbon, and isopropyl compounds and exhibits similarities in organic structure to turpentine, dipentine compounds. The d-Limonene is mixed with a liquid detergent containing ionic and anionic surfactants in a ratio of two parts detergent to one part d-Limonene. To this mixture is added a fifty (50%) percent mixture of bicarbonate of soda and slaked lime solution in a ratio of three parts soda/lime solution to one part d-Limonene to serve as a buffer for the high acid content of the d-Limonene. Water is then added under pressure in a ratio of three parts water to one part of the total mixture to create turbulence and a complete mixing by surface aeration. This mixture is then allowed to settle out into a top emulsified cream layer and a lower clear liquid layer containing the buffered d-Limonene. The clear liquid layer is decanted off to be used as the cleansing solution. Liquid ammonia may then be added to the clear solution as a drying agent in a ratio of three parts ammonia to one part clear liquid layer.

7 Claims, No Drawings

PROCESS FOR PRODUCING BLENDED D-LIMONENE AND USES OF THE BLENDED PRODUCT

This is a continuation-in-part of the copending application bearing Ser. No. 523,049, filed Aug. 15, 1983, now abandoned.

BACKGROUND OF THE INVENTION

1. Field of the Invention

The present invention relates to a process for blending natural d-Limonene with other substances and developing a product with a great range of uses for cleaning and otherwise.

2. General Background

In the particular area of products utilized for cleaning, particularly liquid cleaners, a wide range of products have been developed for the purpose of cleaning and polishing substances such as metals, precious stones, fine wood finishes, and various other surface materials which from time to time need to be cleaned. All too often, the particular cleaning agent as with most cleaning agents which have been developed are a rather caustic and harmful substance which over long, extended periods of use, have sufficient shortcomings to require that the substances be used over a limited period of time, and not over an extended period, so as to avoid damage to the particular surface or item being cleaned. In order to overcome this problem, efforts have been made in producing liquified cleansing products for wood, metals, or the like which are derivatives of natural products and non-caustic to human contact. An example might be such popular products trademarked as GLADE, WINDEX, and similar products. In addition, products which are utilized for cutting grease or the like would be for the most part a caustic, abrasive type of compound which relys heavily on friction in addition to the soap contained in the product to effect cleansing. These aforementioned products all fall short in view that, again over extended periods of time, several ingredients contained therein in addition to the natural compounds tend to cause problems either with contact with the human skin or in discoloration of the item being cleaned.

SUMMARY OF THE PRESENT INVENTION

In order to overcome the shortcomings in the art, in its present status, the process and products of the present invention overcome these problems by introducing a natural, organic, non-toxic peel oil derivative. This derivative, entitled d-Limonene, is produced through a particular process for deriving a compound which has the ability to serve as a primary cleansing agent with a multitude of uses and is basically harmless to human skin, depending on the various strength of its ingredients. The d'Limonene extract would be obtained from a non-toxic peel oil derivative containing a high citric acid, carbon, and isopropyl compound exhibiting some similarity in organic structure to turpentine, dipentine compounds. d-Limonene is derived from lemon, bergamot, caraway, orange, peppermint, spearmint, and other oils. The d-Limonene is introduced into a containment tank and blended with a specific portion of liquid detergent containing ionic and anionic surfactants. A mixture of bicarbonate of soda and slaked lime solution, preferably a fifty (50%) percent mixture, is then added to the d-Limonene/surfactant mixture. Pressurized water is then introduced into the mixture to create a turbulence so that surface aeration occurs. The water is preferably added in approximately a three-to-one ratio. The blended mixture is then allowed to set during which a process of separation occurs between the lighter d-Limonene and detergent oils and the surfactants which rise to the surface in cohesive suspension. Following the separation process, the clear lower liquid layer below the upper cream layer which consists of water, surfactants, and d-Limonene isopropyls is decanted off to a separate container. This clear liquid is then added to a solutin of ammonia for assisting as a drying agent. The product is then ready to be utilized in its various uses.

In view of the above, it is an object of the present invention to provide a process for producing a non-toxic natural oil derivative product to be used as a primary cleaning agent for a variety of uses.

It is another object of the present invention to provide a process whereby non-toxic, organic, and natural compounds are blended for producing a cleaning agent.

It is a further object of the present invention to provide a process whereby a d-Limonene blended mixture is obtained which has a multitude of uses, including glass cleaner, chrome cleaner, grease cutter, etc.

DETAILED DESCRIPTION OF THE PREFERRED EMBODIMENT

The process of the present invention is a process whereby a natural, organic, non-toxic orange peel oil derivative, hereinafter referred to as d-Limonene, is blended with various substances for producing a general cleaning agent. d-Limonene is basically, in the present state of the art, a high citric acid, carbon, isopropyl compound exhibiting some similarities in organic structure to turpentine, dipentine compounds and is derived principally from manufacturing cattle food from the peels of oranges. At the present time, d-Limonene would be considered a raw waste material collected and stored for the most part for the prevention of high acid extract from being dumped on the environment.

The subject matter with the process of the present invention would utilize this heretofore waste high-acid extract in a unique and useful compound with its prime usefulness being a glass and chrome or metal cleaner and polish in addition to a multitude of other uses. In its natural full-strength state, due to its high citric acid and certain isopropyl compound content, it would not be utilized in full strength but would be blended in order to exemplify the outstanding cleaning product that it is. This particular blending process would be as follows:

The first step in the blending process is to introduce a specific quantity of d-Limonene, obtained as the raw waste material, into a containment tank, the quantity of d-Limonene depending on the size of the containment tank used. The next step would be to introduce a specific volume of liquid detergent for blending with the d-Limonene under mild to moderate agitation. The volume of detergent may vary between 1:1–3:1 in a ratio of detergent to d-Limonene and is preferably 2:1 of detergent to d-Limonene. The detergent is preferably a liquid detergent, such as, normal dish washing liquids marketed under the tradename of "JOY" and containing a combination of ionic and anionic surfactants. The next step would be to introduce a solution of bicarbonate of soda and slaked lime solution, which comprises equal volumes of each, into the blended d-Limonene and detergent mixture. The bicarbonate of soda and slaked lime solution serves as a buffer for neutralizing the acid content of the d-Limonene and may be introduced in a ratio to the d-Limonene of 1:1-3:1 by volume of soda and lime mixture to d-Limonene and is preferably in the ratio of 3:1. The soda/lime solution should be introduced into the detergent and d-Limonene mixture while it is undergoing agitation to ensure adequate mixing of the solutions. After the completion of the preceeding step, the completed mixture is then mixed with water on a ratio of 2:1-3:1 of water to d-Limonene mixture. The water is preferably added on a ratio of three-to-one of water to d-Limonene mixture. The water amount may be varied depending on the strength of the final solution desired or the final product may be further diluted if desired.

During the mixing of the water into the solution, it must be ensured that the mixing be done with the water stream under sufficient pressure to create substantial turbulence within the mixture so that the surface aeration causes breaking of the surface tension of the liquid. A succesful introduction of water under pressure in this step is indicated by a color change in the solution. The mixture is transformed from a clear mixture into a pearl white mixture as the substantial agitation causes mixing of the soda/lime and detergent with the acids in the d-Limonene to form a cream.

Once the water is introduced with sufficient agitation, a settling period is allowed so that the lighter d-Limonene, detergent, oils, and surfactants may rise to the surface in cohesive suspension in the form of a cream emulsion between the d-Limonene acids, the soda/lime alkalines, and the water hydrogen molecules. The emulsified cream layer will rise to the top as d-Limonene has a specific gravity of approximately 0.8411 to 0.8422 and the cream layer is comprised of a substantial amount of oils and acids removed from the useful cleaning portion of the d-Limonene extract. The bicarbonate of soda and slaked lime solution additive are provided during that particular step as a buffer which assists in neutralizing any d-Limonene acids which would remain in the clear liquid layer and tend to sting the skin.

Following the separation period between the d-Limonene cream layer and the clear liquid layer, the clear bottom layer is then decanted off to a separate container. The clear liquid layer is comprised primarily of the water, soda and lime akalines, which act as buffers and a portion of the d-Limonene isopropyls with their detergent properties which are suspended in the water layer. Following this separation of the clear liquid, ammonia is added to the clear liquid to assist as a drying agent when used as a cleanser. The ammonia is added to the clear liquid in a preferable range of a three-to-one ratio of ammonia to the clear liquid. The product is then ready to be utilized as a cleaning agent, as stated earlier. Should the clear layer be intended for use where a drying agent is unnecessary, the addition of the ammonia may be deleted.

Possible uses for d'Limonene are as follows:

Tar Remover—full strength
Chewing Gum Remover—full strength
Degreaser—full strength
Cosmoline Remover—full strength
Wax Remover—full strength
Rust Remover—full strength
Artist Oil Remover—full strength
Typewritter Key Cleaner—full strength
PVC Cleaner—full strength
Decarbonizer—full strength
Filter Cleaner—full strength
Dead Paint Remover—full strength
Carburetor Cleaner—full strength
White Sidewall Cleaner—full strength
Paint Brush Cleaner—full strength
Disinfector—full strength
Deodorizer—full strength or dilute with baby oil.
Tennis Shoe Cleaner—full strength or dilute with liquid soap.
Laundry additive—$\frac{1}{4}$ to $\frac{1}{2}$ cup per washer load.
Panel Cleaner—full strength or dilute with liquid soap.
Black Iron Pots and Pans—full strength or dilute with liquid soap.
Mildew Remover—full strength or dilute with liquid soap.
Oven, Stove, Pot Cleaner—full strength or dilute with liquid soap.
Tile Cleaner—full strength or dilute with liquid soap.
Crayon Remover—full strength
Carpet spotter—full strength or dilute with shampoo.
Porcelain Cleaner—full strength or dilute with liquid soap.
Stainless Steel Cleaner—full strength or dilute with liquid soap.
Silver and Chrome Cleaner—full strength
Jewelry Cleaner—full strength or add 25% ammonia.
Animal Stain Remover—full strength or dilute with liquid soap Because of is volatility and nature of composition, being basically a turpentine, dipentine, isopropyl compound of high hydrogen and carbon content, d-Limonene has a variety of petroleum related uses. These petroleum related uses would be areas wherein the addition of ammonia as a drying agent would be deleted from the process in producing the final product. d-Limonene is useful as a reclamation agent wherein it exhibits a remarkable ability to cleanse used crankcase oil by a process of percolation wherein the oil is weeped and percolated slowly through the d-Limonene liquid. In this process, the used crankcase oil is slowly introduced into a container containing the d-Limonene product and the oil is slowly weeped through the d-Limonene liquid in a constant flow. As the oil passes through the d-Limonene, it is preferably percolated to remain in contact with the d-Limonene product. This results in a process wherein the d-Limonene leaches out the high grade unbroken oil by a molecular adhesion of the high grade oil with the d-Limonene. This is a comingling action and allows the impurities in the crankcase oil to drain to the bottom of the container where they may be drained off. This mixture of high grade oil and d-Limonene need not be separated due to the high hydrogen and carbon content of the d-Limonene. This mixture is then a serviceable oil. The preferred range of d-Limonene to oil is large and is between 0.1% to 50%.

d-Limonene may also be used as a fuel additive for diesel or gasoline where it is mixed and coalesces with gasoline and diesel of all grade levels. In spite of the carbon content in d-Limonene being dissimilar to petroleum carbons, the mixture exhibits an upgraded flammability due to the compatibility of d-Limonene with petroleum fuels. The mixture thus burns clean and without visual emissions. It also provides an excellent engine decarbonizer in that it has a tendency to dissolve petroleum carbons deposited on the engine surfaces and will not deposit its own carbons on engine surfaces under compression combustion. The use as an additive also prevents resin build-up in carburetors or injectors and is an aid in freeing stuck or restricted valves. The removal of carbon and prevention of resin build-up and freeing of stuck or restricted valves results in an increase in mileage. The preferred ratio is that of approximately one part d-Limonene to twenty parts diesel or gasoline.

The d-Limonene product is also useful in both the drilling and refining segments of the petroleum industry. d-Limonene may be used to dissolve and suspend all forms of paraffin in solution in a variety of applications in the petroleum industry as indicated. The preferred concentration of the d-Limonene in this application is between sixty (60%) percent to one-hundred (100%) percent d-Limonene.

d-Limonene is useful also as a crankcase additive to prevent sludge and resin formation in the lubricant supply section of an internal combustion engine. The preferred range is one part of d-Limonene to every thirty-two parts of lubricant.

d-Limonene is also useful as an additive in petroleum solvents since it exhibits amazing performance in releasing rusted threads, pistons and valves in frozen engines, pumps, compressors, etc. In this use, the d-Limonene may be used at full strength or at a ratio of a ninety (90%) percent d-Limonene to ten (10%) percent oil.

d-Limonene may also be used as a refining agent for all forms of crude or partially refined petroleums whereby it separates the petroleum products from water and separates the oil from undesirable particulates present. These undesirable particulates are normally comprised of solidified carbons, sulfer, etc. By the nature of the composition of d-Limonene, the oil or petroleum product is upgraded by the addition thereof due to its high compatibility with petroleum. This results from the fine grade citrus oil in the d-Limonene product.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A process for producing a d-Limonene cleaning agent, which comprises the following steps:

a. providing d-Limonene compound;

b. blending said compound with a 2:1 to 3:1 ratio of a liquid detergent selected from anionic and ionic surfactants and mixtures thereof;

c. agitating said blended mixture;

d. adding a mixture of bicarbonate of soda and slaked lime solution in a range of 2:1 to 3:1 by volume during the agitation of said mixture;

e. mixing said agitated mixture with pressurized water at a ratio of 3:1 of water to d-Limonene mixture;

f. allowing said hydrated mixture to separate into a top emulsified layer and a bottom clear liquid layer; and g. decanting said clear liquid layer for use as said cleaning agent.

2. The process of claim 1, wherein the water added to the agitated mixture is added under pressure for creating turbulence with said mixture.

3. The process of claim 1, wherein the portion of liquid detergent does not exceed a three-to-one ratio of detergent to d-Limonene extract.

4. The process of claim 1, wherein said bicarbonate of soda and slaked lime solution additives serve as a buffer for neutralizing the d-Limonene acids within the mixture.

5. The process of claim 1, further comprising the addition of ammonia to said clear liquid layer for use as a drying agent in a range of 2:1 to 3:1 by volume of ammonia to said clear liquid layer.

6. A process for producing a d-Limonene cleaning agent, comprising the following steps:

a. providing d-Limonene compound;

b. blending said d-Limonene compound with a 2:1 ratio of liquid detergent containing a mixture of ionic and anionic surfactants;

c. agitating said blended mixture;

d. adding a fifty (50%) percent mixture of bicarbonate of soda and slaked lime solution in a ratio of 3:1 by volume of said soda/lime solution to said d-Limonene during said agitation of said blended mixture;

e. mixing said blended mixture wth pressurized water at a ratio of 3:1 by volume of water to said blended mixture;

f. allowing said hydrated mixture to separate into a top emulsified cream layer and a bottom clear liquid layer; and g. decanting said clear liquid layer for use as said cleaning agent.

7. The process of claim 6, further comprising the addition of liquid ammonia to said clear liquid layer in a ratio of 3:1 by volume of ammonia to said clear liquid layer for use as drying agent.

* * * * *